US009022620B2

(12) United States Patent
Brinzey

(10) Patent No.: US 9,022,620 B2
(45) Date of Patent: May 5, 2015

(54) ORIENTABLE TACTICAL LIGHT

(71) Applicant: George Walter Hulak Brinzey, Charlotte, NC (US)

(72) Inventor: George Walter Hulak Brinzey, Charlotte, NC (US)

( * ) Notice: Subject to any disclaimer, the term of this patent is extended or adjusted under 35 U.S.C. 154(b) by 118 days.

(21) Appl. No.: 13/768,833

(22) Filed: Feb. 15, 2013

(65) Prior Publication Data

US 2013/0215624 A1 Aug. 22, 2013

Related U.S. Application Data

(60) Provisional application No. 61/599,882, filed on Feb. 16, 2012.

(51) Int. Cl.

| | |
|---|---|
| ***F21V 15/00*** | (2006.01) |
| ***F21V 15/01*** | (2006.01) |
| ***F41H 13/00*** | (2006.01) |
| ***F42B 12/42*** | (2006.01) |

(52) U.S. Cl.
CPC ..... *F21V 15/01* (2013.01); *F41H 13/0087* (2013.01); *F42B 12/42* (2013.01)

(58) Field of Classification Search
CPC ..... F21V 15/01
USPC ..... 362/362, 253; 102/502
See application file for complete search history.

(56) References Cited

U.S. PATENT DOCUMENTS

| | | | | |
|---|---|---|---|---|
| 3,596,078 | A * | 7/1971 | Owens | 362/184 |
| 4,985,813 | A | 1/1991 | Putman | |
| 6,831,699 | B2 | 12/2004 | Chang et al. | |
| 7,093,962 | B2 * | 8/2006 | Mahoney | 362/363 |
| 7,333,148 | B2 * | 2/2008 | Chang et al. | 348/374 |
| 2008/0239708 | A1 | 10/2008 | Bushee | |
| 2009/0251889 | A1 * | 10/2009 | Bushee | 362/112 |

* cited by examiner

*Primary Examiner* — Stephen F Husar
(74) *Attorney, Agent, or Firm* — Thomas D. McClure, Jr.

(57) ABSTRACT

The present invention provides a tactical light configured such that it can be propelled toward a predetermined location. The tactical light includes a housing that defines an interior space. An effects assembly is configured to be positioned within the interior space defined by the housing. The effects assembly is rotatably connected to the housing by a rotary connector. The effects assembly is configured such that it has a center of gravity that is offset from an axis defined by the rotary connectors. In this regard, a light source positioned on the effects assembly is configured to illuminate a predetermined area relative to the effects assembly and its center of gravity and independent of the position of the surface of the housing relative to effects assembly.

10 Claims, 8 Drawing Sheets

ORIENTABLE TACTICAL LIGHT

FIELD OF THE INVENTION

The invention relates generally to lighting and specifically to a light emitting device, such as a tactical light, that is configured to return to a predetermined orientation after being thrown or rolled.

BACKGROUND OF THE INVENTION

Tactical lights are used by persons or groups such as military and police to provide illumination and distractions in areas where they are entering. Conventional tactical lights are configured to be tossed into a room away from the user. One purpose of a tactical light is to provide illumination of an area without disclosing the location of the user of the tactical light. In contrast, a conventional hand held flash light identifies the location of the user. Conventional tactical lights can be configured such that they generate a beam of light that is directed away from a support surface. In this regard, some conventional tactical lights are weighted such that they are self-righting. As a result, light can be emitted upward.

It is believed that one problem with conventional self-righting tactical lights is that the beam of light wobbles in all directions as the device bounces and rolls away from the user.

Another problem with conventional self-righting tactical lights is that the beam of light cannot be generally fixed in a predetermined direction relative to the light's center of gravity.

Another problem with conventional self-righting tactical lights is that they cannot be predictably rolled toward a predetermined location. It is believed that the offset center of gravity of conventional tactical lights negatively affects the ability to roll such a light in a predictable manner.

SUMMARY OF THE INVENTION

The present invention addresses the foregoing problems by providing a tactical lighting device configured to project light at a predetermined direction relative to its center of gravity both as it is being tossed or rolled near a predetermined location and when it comes to rest. More specifically, the tactical light is configured to roll in a predictable manner such that it can be propelled toward a predetermined location.

According to one embodiment of the present invention, there is provided a housing having a central axis. A deck is attached to the housing such that the deck can move about the central axis relative to the housing. The deck is configured to have a first side and a second side wherein the first side is oriented upwards when the housing is at rest and the second side is oriented downwards. In this regards, the center of gravity of the deck is located such that it is offset from the axis. The offset center of gravity is not fixed relative to the housing but it is fixed relative to light emitting components attached to the deck.

According to one aspect of the present invention, the tactical light provides visual diversionary features. In this regard, light produced by the present invention can be configured to move relative to the environment outside of the housing in accordance with motion of the housing. It is believed that resulting unstable areas of shadow and light act to distract and divert attention away from the user of the tactical light.

According to another aspect of the present invention, an spl alerter function is also positioned in the housing. As used herein, the term "spl alerter" refers to a device configured to generate high decibel sound waves, i.e. a "sound pressure level alerter". In other words, a device configured to provide sound pressure levels that are distracting, attention getting, and it is believed, in some cases painful.

According to one embodiment of the present invention, there is provided a tactical light configured such that it can be propelled toward a predetermined location, the tactical light. The tactical light includes a housing that defines an interior space and an effects assembly configured to be positioned within the interior space defined by the housing. The effects assembly is rotatably connected to the housing by a rotary connector, and the effects assembly is configured such that it has a center of gravity that is offset from an axis defined by the rotary connector.

According to one aspect of present invention, the housing is configured to be rolled toward a predetermined target.

According to another aspect of present invention, the housing includes an outer surface that has ridges defined on it.

According to another aspect of present invention, the ridges are configured to limit motion of the housing when the housing is at rest.

According to another aspect of present invention, the effects assembly includes a light source that can be switched between a first mode wherein the light source emits light and a second mode wherein the light source does not emit light.

According to another aspect of present invention, the light source is positioned such that light is emit in a predetermined direction relative to the center of gravity of the effects assembly.

According to another aspect of present invention, the rotary connector can be locked such that the center of gravity of the effects assembly is fixed in relation to the housing.

According to another embodiment of the present invention, there is provided a tactical sensory device configured to illuminate predetermined areas. The device includes a housing and an assembly. The assembly is configured to be retained within the housing and is movably supported by the housing and the assembly has a center of gravity that is offset from an axis of rotation of the housing. A light source is positioned on the assembly such that the light source can illuminate an area that is positioned in a predetermined relative location with regards to the assembly. According to one aspect of present invention, the assembly is configured to produce multiple sensory effects.

According to one aspect of present invention, the multiple sensory effects include one of the following: light, smell, noise, tear gas, and a combination thereof.

According to another aspect of present invention, the light source can be switched between an on-mode and an-off mode remotely.

According to another aspect of present invention, the predetermined direction is located to one side of the center of gravity of the effects assembly.

According to another aspect of present invention, the predetermined direction is above the center of gravity of the effects assembly.

According to another aspect of present invention, the predetermined direction is below the center of gravity of the effects assembly.

According to another aspect of present invention, the housing has an outer surface and the housing is configured to come to rest such that which portion of the outer surface contacts the ground that is independent of the position of the effects assembly.

According to another embodiment of the present invention, there is provided a method that includes the steps of: A) providing a housing that defines an interior space; an effects assembly configured to be positioned within the interior space defined by the housing and the effects assembly is rotatably connected to the housing by a rotary connector; and wherein the effects assembly is configured such that it has a center of gravity that is offset from an axis defined by the rotary connector and a light source is positioned on the effects assembly such that an area positioned in a predetermined direction relative to the effects assembly is illuminated; B) arming the effects assembly; C) launching the housing; and D) activating the light source.

According to another aspect of present invention, the method of operating a tactical light further includes the step of:

locking the position of the effects assembly relative to the housing.

BRIEF DESCRIPTION OF THE DRAWINGS

For a fuller understanding of the nature and objects of the present invention, reference should be made to the following detailed description taken in connection with the accompanying drawings, wherein.

DETAILED DESCRIPTION OF THE PREFERRED EMBODIMENTS

Figure 3:
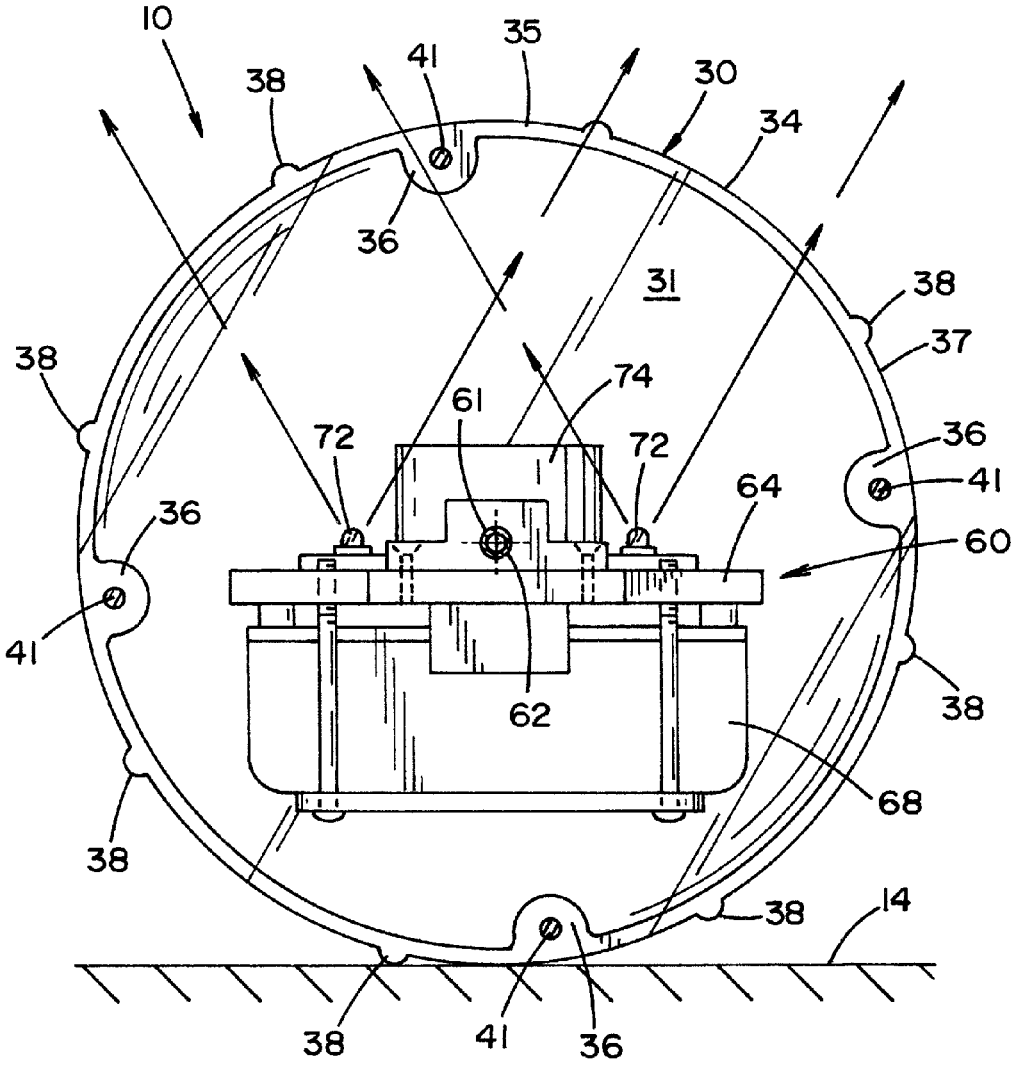
FIG. 3 is a sectional end view of a tactical light according to the present invention showing light emitted upwards relative to the center of gravity of the deck.
Figure 4:
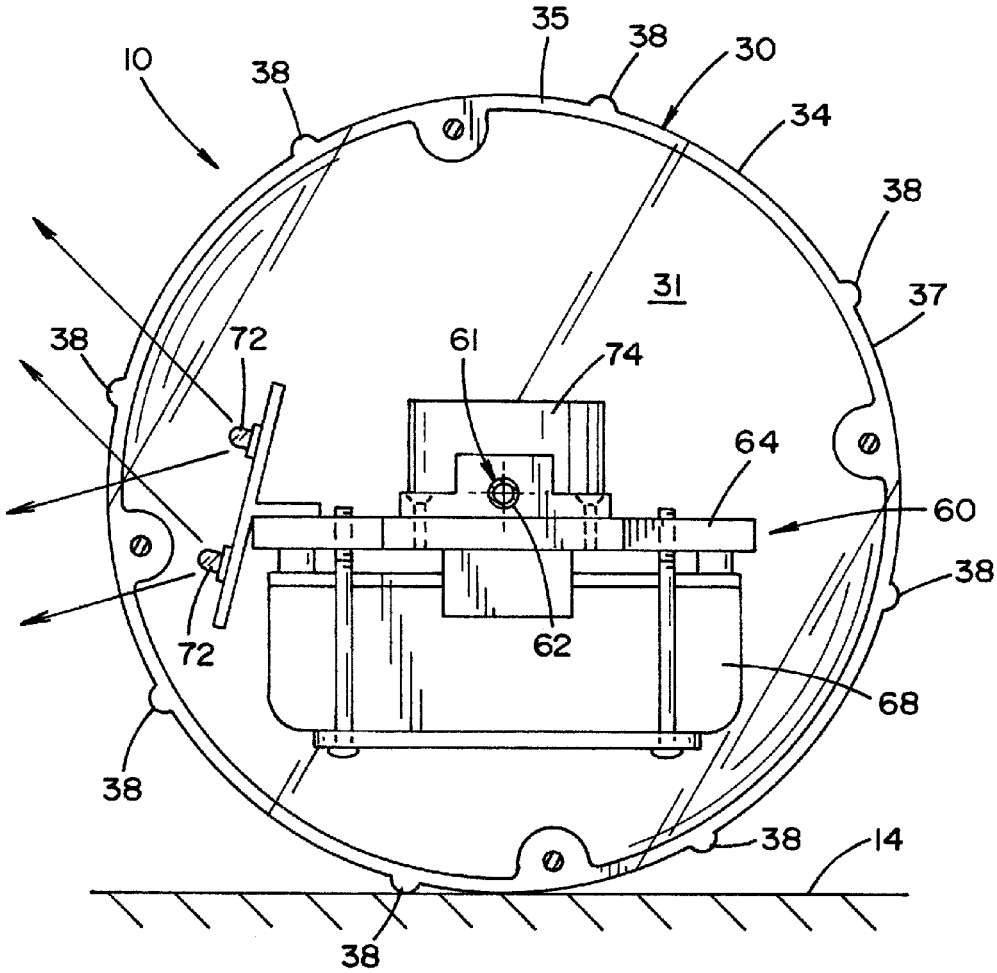
FIG. 4 is a sectional end view of a tactical light according to the present invention showing light emitted to one side of the deck.
Figure 5:
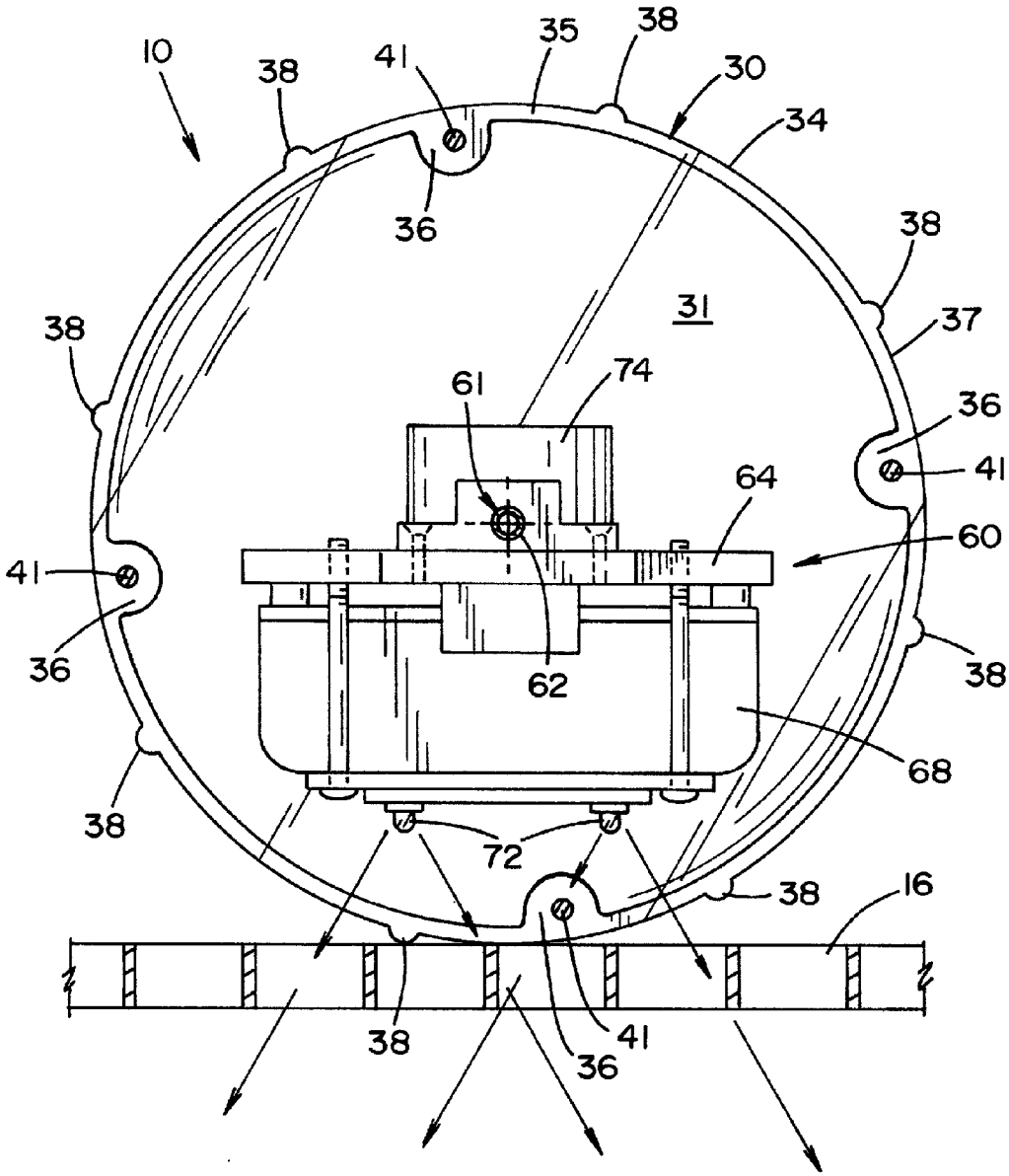
FIG. 5 is a sectional view of a tactical light according to the present invention taken from one end and showing light emitted down from the deck such that the light can be transmitted through a grating or floor.

Embodiments of the present invention are directed to a tactical light 10 in which a propelled device is provided that can emit light in predetermined orientation relative to its center of gravity when light 10 is at rest and when light 10 is in motion. In this regard tactical light 10 can be rolled, tossed, otherwise launched with relative precision toward a predetermined location such that a predetermined area or areas are illuminated. Tactical light 10 is configured to come to rest on a surface such as a floor 14 as shown in FIGS. 3 and 4 or a grate 16, such as an expanded metal decking, as shown in FIG. 5.

Figure 1:
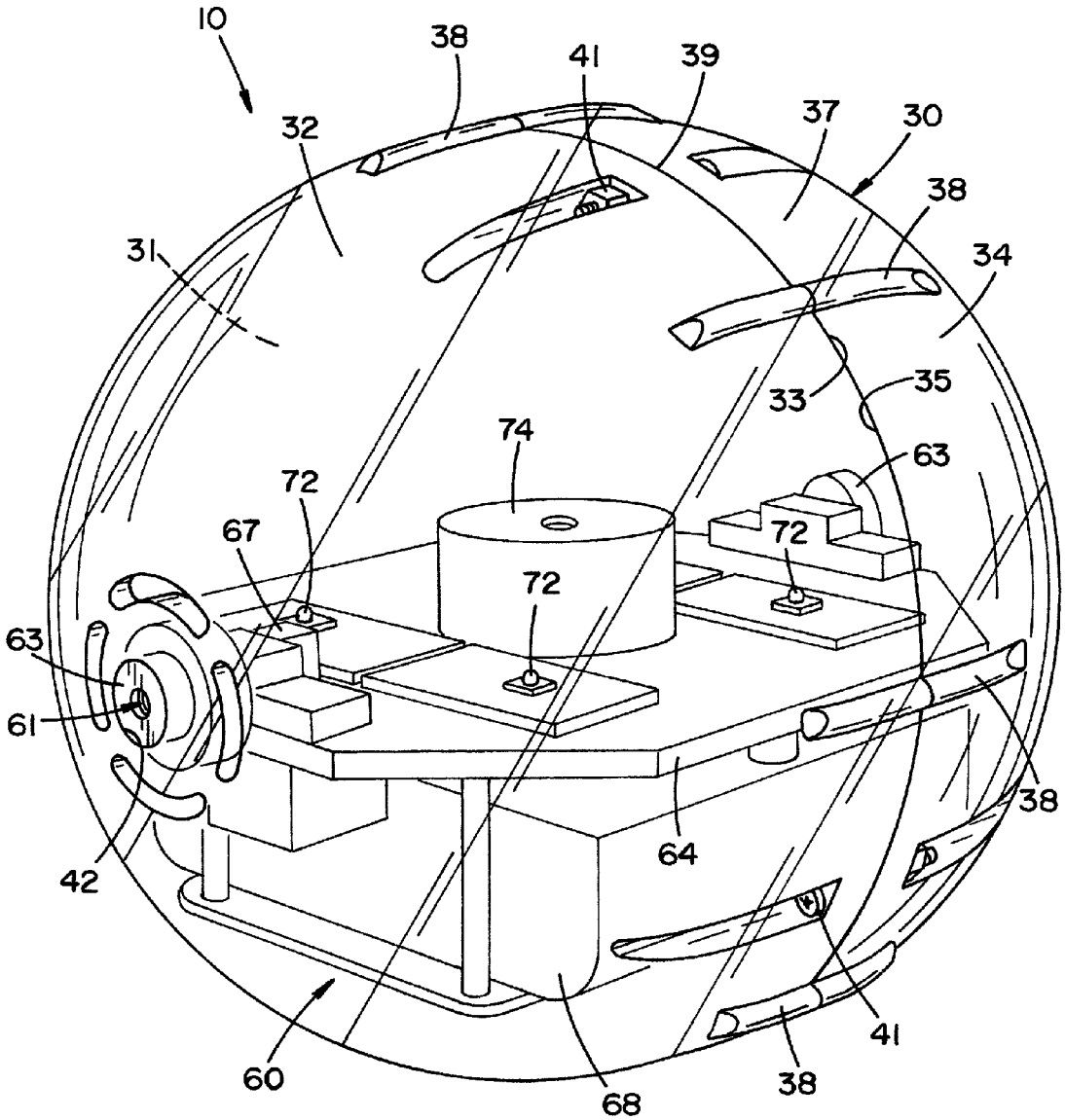
FIG. 1 is a perspective view of a tactical light according to the present invention wherein the housing is substantially transparent and light emitting sources are configured to positioned above the center of gravity and positioned to direct light away from the center of gravity.

Referring to FIGS. 1, 2, 7, and 8; in accordance with an embodiment of the invention, a tactical light includes a housing 30 having a substantially circular cross section. Housing 30 defines an interior space 31 that is configured to receive an effects assembly 60. Housing 30 includes a first shell 32 and a second shell 34. First shell section 32 and second shell section 34 come together along corresponding edges 33 and 35 as shown in FIG. 1. In the illustrated embodiment, first edge 33 and second edge 35 are substantially circular and first shell section 32 and second shell section 34 both extend away from first edge 33 and second edge 35 respectively. By way of example and not limitation, housing 30 can be spherical, oblong, cigar-shaped, and a combination thereof. In the illustrated embodiment, a plurality of ridges 38 is positioned on an outer surface 37 of housing 30. Ridges 38 are configured to inhibit rolling when tactical light 10 is at rest. In this regard, illumination provided by tactical light 10 is maintained in a substantially predetermined orientation when light 10 is at rest.

Figure 2:
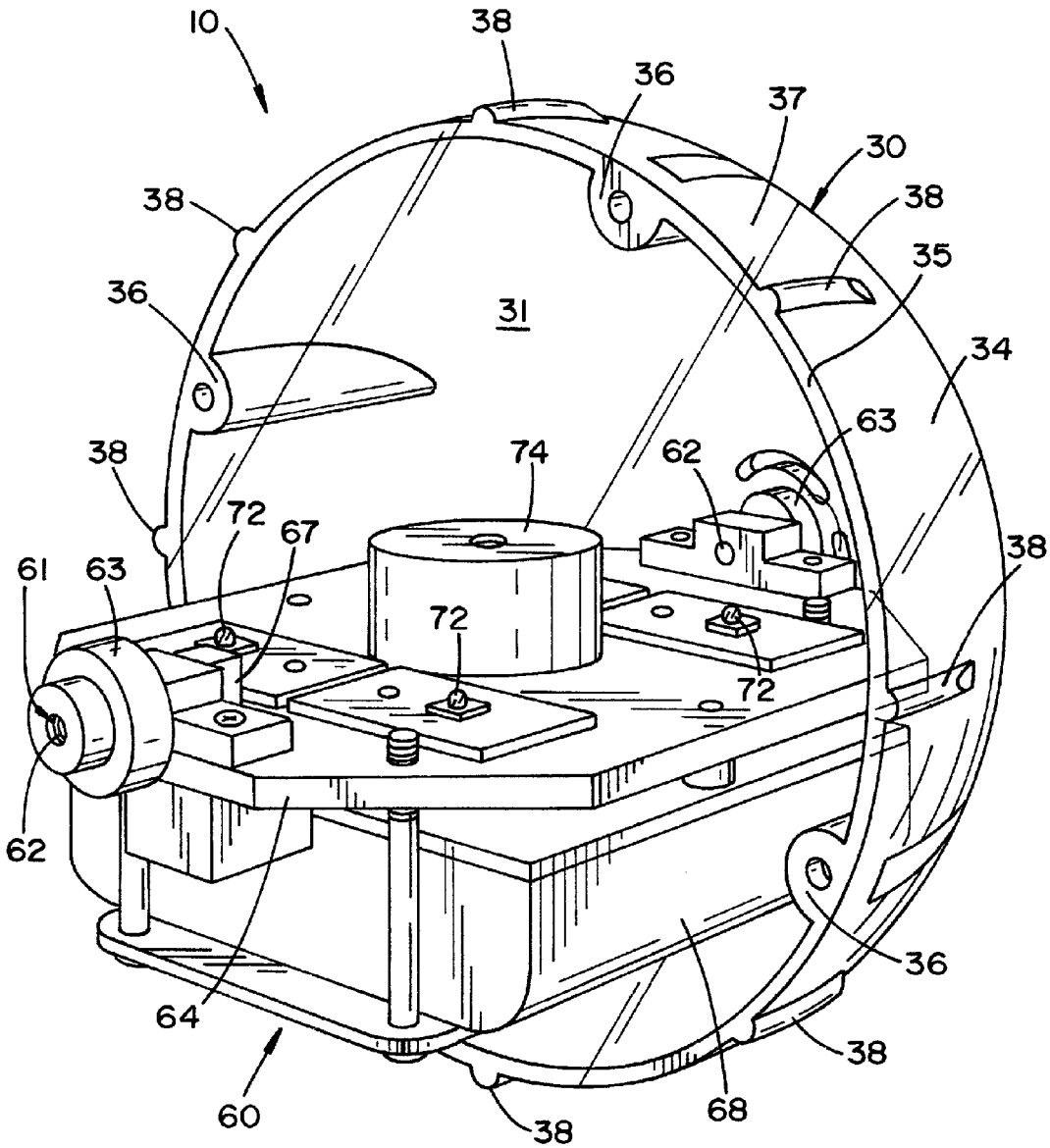
FIG. 2 is a perspective view of the tactical light in FIG. 1 wherein a portion of the housing has been removed to provide an unimpeded view of the space within the housing wherein the electronics and light source are positioned as a part of a deck.

First shell section 32 and second shell section 34 are configured to join together such that a centerline 39 is defined around the circumference of housing 30 along the interface of corresponding edges 33 and 35. In the illustrated embodiment, centerline 39 defines a circle that lies in one plane. It should be appreciated that in other embodiments, centerline 39 deviates from one plane such that first shell 32 and second shell 34 interlock at the centerline as shown in FIGS. 2 and 3. Lugs 36 are defined in first shell 32 and second shell 34. Each of lugs 36 are configured to receive connecting devices such as bolts 41 such that first shell 32 and second shell 34 can be joined together. Each of first shell 32 and second shell 34 include a hole 42 positioned on an axis of housing 10. Each hole 42 is configured to receive a rotary connector 61 described below.

Referring now to FIG. 2, as indicated above housing 30 defines an interior space 31 that is configured to receive effects assembly 60. Assembly 60 includes a deck 64 and a battery and controls package 68. The battery is configured to provide electrical power to package 68 and can be rechargeable. Controls package 68 includes data processors and hardware and software configured to receive electronic communication and instructions. Package 68 and it is configured to activate features of light 10 according to those instructions in a predetermined manner. The effects assembly 60 has a center of gravity that is offset from the axis defined by axle 62 of housing 30 such that deck 64 is normally positioned above package 68. It should be appreciated that in the illustrated embodiment, the mass of package 68 determines the position of the center of gravity. In other embodiments, the position of the center of gravity is determined by the relative positions of weighted members or other structure attached to deck 64.

As can be seen in FIG. 2, effects assembly 60 includes a plurality of light sources 72. Light source 72 is positioned on the assembly such that the light source can illuminate an area that is positioned in a predetermined relative location with regards to assembly 60. In the illustrated embodiment, light sources 72 are light emitting diodes (LEDs) that are positioned on deck 64 such that light is emitted generally upward and and away from deck 64 and away from the center of gravity of assembly 60 as indicated by the arrows in FIG. 3. In this configuration, light is generally emitted toward an area above tactical light 10 as it is rolled toward a predetermined area or target.

As shown in FIG. 4, light sources 72 are positioned along one side of assembly 60 such that light is generally emitted toward an area that is slightly up and to the side of tactical light 10 as indicated by the arrows in FIG. 4. As shown in FIG. 5, light sources 72 are positioned below assembly 60 such that light is emitted toward an area that is generally below tactical light 10 as indicated by the arrows in FIG. 5. In this configuration, tactical light 10 can be positioned on grate 16 or other support surface that is configured to allow light to pass through. Such a support surface can be transparent or perforated such as an expanded metal floor or grating. In this manner, tactical light 10 can be used to illuminate a room or area below tactical light 10 such as a sump area or industrial floor or mezzanine. Light sources 72 are configured to be switched between a first, illuminated mode where light is emitted from light sources 72 and a second, non-illuminated mode where light is not emitted from light sources 72. Stated another way, when in the first mode light sources 72 are on and when in the second mode, light sources 72 are off. It is believed that as light 10 is rolled, light emitted therefrom is cast about in manner that can be a distraction.

Effects assembly 60 is rotatably attached to first shell 32 and second shell 34 of housing 30 by the rotary connector 61. According to the illustrated embodiment, rotary connector 61 includes at least one axle 62 and at least one flexible bushing 63. Flexible bushing 63 is configured to be received within a corresponding hole 42 of housing 30. Axle 62 defines an axis around which effects assembly 60 moves relative to housing 30. The axis is also the axis of rotation around which housing 30 rotates when light 10 is rolled. It should be appreciated that the position of housing 30 relative to effects assembly 60 can vary and that the position of assembly 60 does not determine what portion of surface 31 of housing 30 comes to rest on floor 14. By way of example and not limitation, the rotary connector can be one of the following: an axle, a ball joint, a race and bearing assembly, a bearing, other connector movable in at least one dimension, and a combination thereof.

Figure 6:
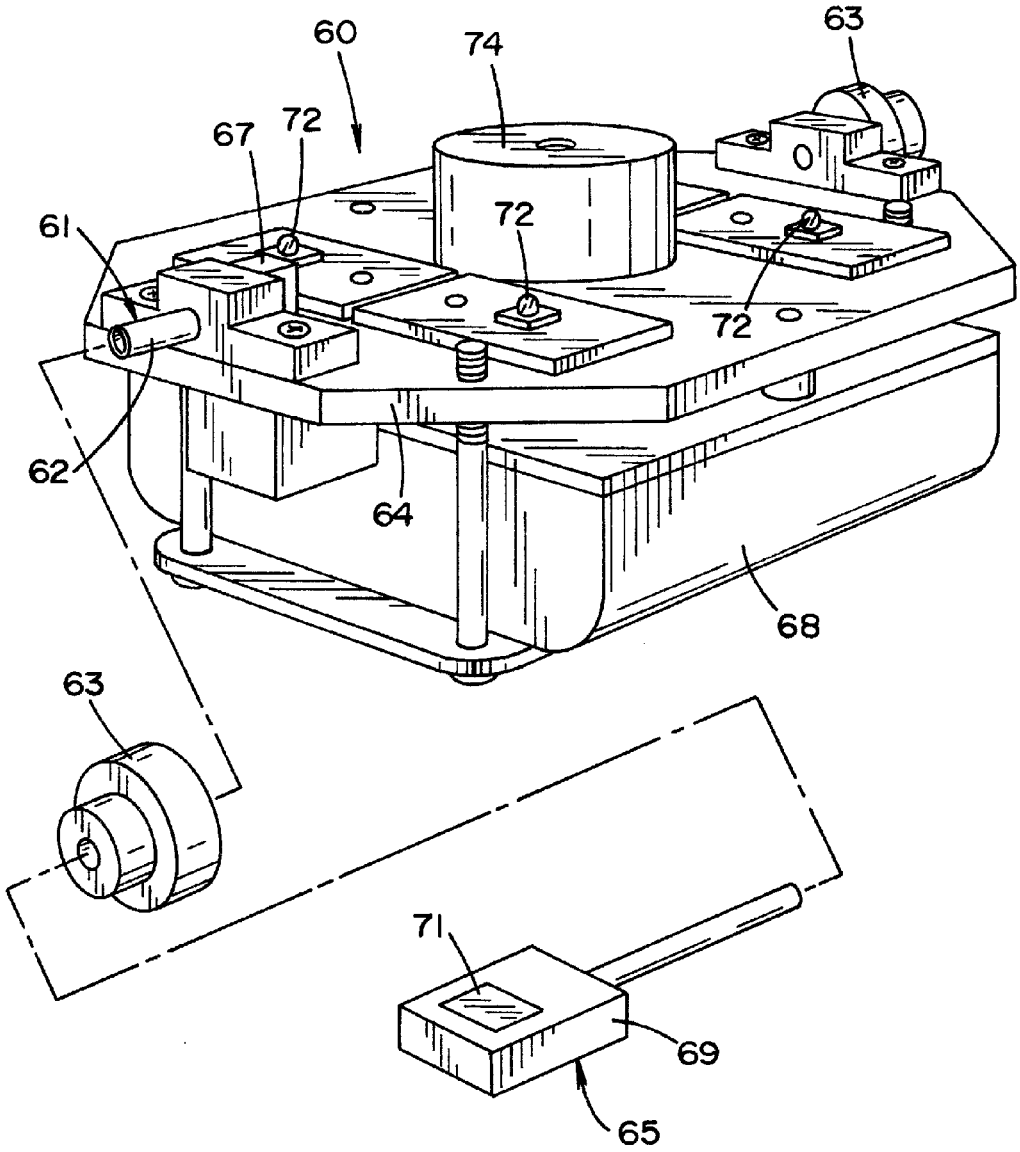
FIG. 6 is an exploded view of the electronics deck showing an axle and a bushing that is configured to position the axle relative to a portion of the housing.
Figure 7:
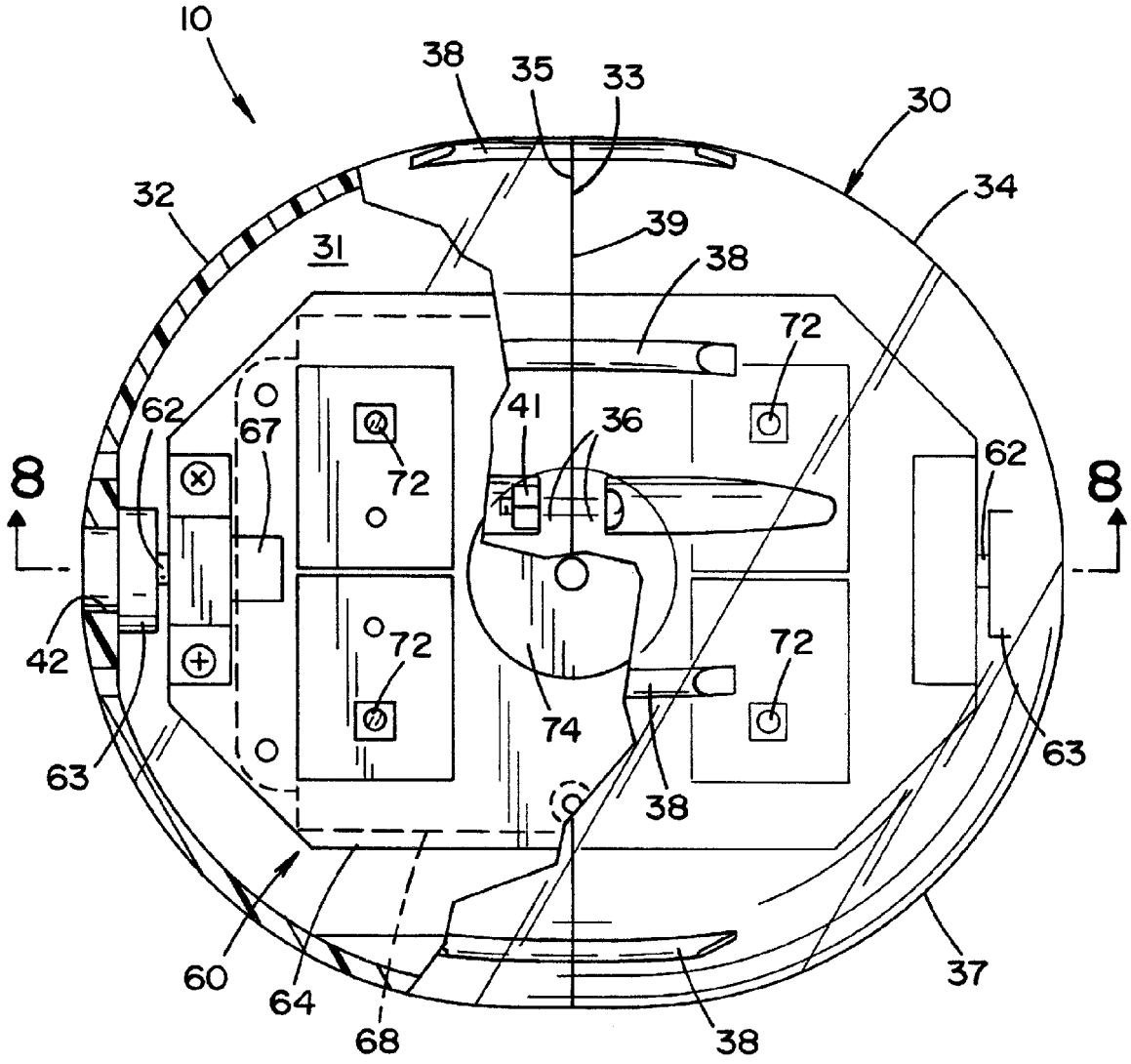
FIG. 7 is a partially sectional plan view of a tactical light according to the present invention.
Figure 8:
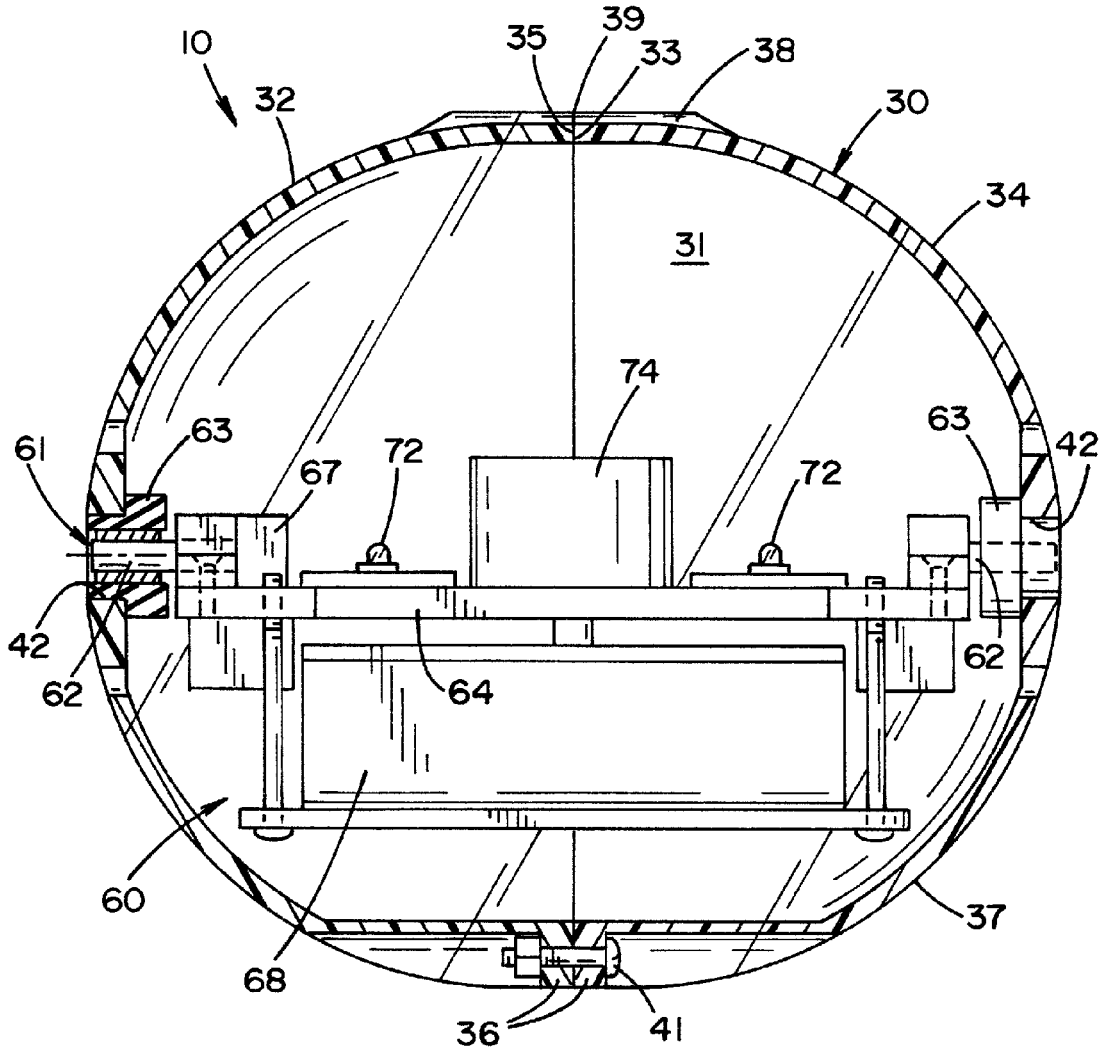
FIG. 8 is a sectional view of a tactical light according to the present invention taken along line 8-8 as indicated in FIG. 7.

Referring now to FIG. 6, in the illustrated embodiment connector 61 is configured to be lockable such that assembly 60 cannot move relative to housing 30. In this regard, a key 65 is configured to engage connector 61 such that connector 61 can be moved between a locked position where assembly 60 cannot move relative to housing 30 and an unlocked position where assembly 60 can move relative to housing 30. When connector 61 is in the locked position, the position of center of gravity of effects assembly 60 relative to housing 30 is fixed. When connector 61 is in the unlocked position, the position of center of gravity of effects assembly 60 relative to housing 30 is not fixed.

Key 65 is also configured to engage an arming switch 67. Arming switch 67 is electrically connected to package 68 and is configured to electrically indicate a disarmed first state and an armed second state. When key 65 is engaged with arming switch 67, arming switch 67 indicates the disarmed first state. When key 65 is not engaged with arming switch 67, arming switch 67 indicates the armed second state. When the armed second state is indicated, package 68 is operable to receive electronic signals to activate light sources 72. In the illustrated embodiment, key 65 includes an integrated remote 69 that is configured to communicate with package 68 via radio frequency signals (RF). Integrated remote 69 includes a button 71. Button 71 is configured such that when it is depressed an RF signal is transmitted from remote 69. This RF signal is received and acted on by package 68. In this manner electronic signals configured to activate light sources 72 are transmitted to package 68.

In the illustrated embodiment, assembly 60 also includes a speaker 74 for emitting disorienting sounds and noises. In should be appreciated that assembly 60 can also include devices for discharging chemicals such as tear gas, smoke, or smells. Assembly 60 can also include lights of different colors, brightness or duration in place of or in addition to light source 72.

Tactical light 10 can be better understood by a description of the operation thereof. Tactical light 10 is tossed or rolled toward the predetermined target area. Light 72 is then illuminated remotely or after a predetermined time. Alternatively, light 72 can be illuminated before being released by the user. One method of using tactical light 10 includes the steps of: arming the effects assembly by removing key 65 from connector 61; launching light 10 by tossing, rolling, or otherwise propelling it away from the user; and activating light source 72. A further step that can be performed with light 10 is locking the position of the effects assembly relative to the housing. This is done by rotating key 65 within connector 61 from the unlocked to the locked position before key 65 is removed.

In some embodiments light 72 and other features, for example tear gas, can be activated by remote control. It should be appreciated that a line or cord can be attached to housing 30 such that light 10 can be retrieved by the user without being required to enter the target area.

It is believed that typical users of tactical light 10 will include persons in military or law enforcement who want to illuminate an area without revealing their location. Tactical light 10 could also be used by those who want to illuminate a predetermined area that might be difficult to access or unsafe, such as the crawl space of a home or a disaster or accident situation such as a wrecked car or collapsed building. Light 10 can be lowered into a disaster scene such as a wrecked car or collapsed building by emergency personnel. When light 10 is in the locked configuration, emergency personnel are better able to predict and determine areas that will be illuminated.

In an alternative embodiment the battery is rechargeable and can be electrically connected to a source for electricity via a conductive pathway through the rotary connector.

In another alternative embodiment housing 30 is configured to be attachable to a user. In this regard, the housing includes a recessed hook or bar that can accept a carabineer, swivel snap, lanyard, or the like. The recessed attachment point is configured such that it does not interfere with how the device rolls.

While the present invention has been illustrated and described with reference to preferred embodiments thereof, it will be apparent to those skilled in the art that modifications can be made and the Invention can be practiced in other environments without departing from the spirit and scope of the invention.

Having described the invention, the following is claimed:

1. A tactical light configured such that it can be propelled toward a predetermined location, the tactical light comprising:

a housing that defines an interior space;

an effects assembly configured to be positioned within the interior space defined by the housing and the effects assembly is rotatably connected to the housing by a rotary connector; and wherein the effects assembly is configured such that it has a center of gravity that is offset from an axis defined by the rotary connector.

2. The tactical light according to claim 1, wherein the housing is configured to be rolled toward a predetermined target.

3. The tactical light according to claim 2, wherein the housing includes an outer surface that has ridges defined on it.

4. The tactical light according to claim 3, wherein the ridges are configured to limit motion of the housing when the housing is at rest.

5. The tactical light according to claim 1, wherein the effects assembly includes a light source that can be switched between a first mode wherein the light source emits light and a second mode wherein the light source does not emit light.

6. The tactical light according to claim 5, wherein the light source is positioned such that light is emitted in a predetermined direction relative to the center of gravity of the effects assembly.

7. The tactical light according to claim 6, wherein the rotary connector can be locked such that the center of gravity of the effects assembly is fixed in relation to the housing.

8. A tactical sensory device configured to illuminate predetermined areas, the device comprising:

a housing;

an assembly configured to be retained within the housing and movably supported by the housing and the assembly has a center of gravity that is offset from an axis of rotation of the housing;

a light source positioned on the assembly such that the light source can illuminate an area that is positioned in a predetermined relative location with regards to the assembly;

wherein the housing has an outer surface and the housing is configured to come to rest such that which portion of the outer surface contacts the ground that is independent of the position of the effects assembly.

9. A method of operating a tactical light, the method including the steps of:

providing a housing that defines an interior space; an effects assembly configured to be positioned within the interior space defined by the housing and the effects assembly is rotatably connected to the housing by a rotary connector; and wherein the effects assembly is configured such that it has a center of gravity that is offset from an axis defined by the rotary connector and a light source is positioned on the effects assembly such that an area positioned in a predetermined direction relative to the effects assembly is illuminated;

arming the effects assembly;

launching the housing; and activating the light source.

10. The method of operating a tactical light according to claim 9, further comprising the step of:

locking the position of the effects assembly relative to the housing.

* * * * *